US005769724A

United States Patent [19]

Wiegel

[11] Patent Number: 5,769,724

[45] Date of Patent: Jun. 23, 1998

[54] HUMAN FREE-FLIGHT CATAPULT

[76] Inventor: Theodore F. Wiegel, P.O. Box 1731, Goldenrod, Fla. 32733

[21] Appl. No.: 745,833

[22] Filed: Nov. 8, 1996

[51] Int. Cl.[6] ..... A63G 31/08

[52] U.S. Cl. ..... 472/49; 472/137

[58] Field of Search ..... 472/49, 50, 3, 472/135, 137; 124/16, 17, 21, 26

[56] References Cited

U.S. PATENT DOCUMENTS

| | | | |
|---|---|---|---|
| 4,583,743 | 4/1986 | Macek . | |
| 5,123,643 | 6/1992 | Heihecker et al. | 124/21 |
| 5,303,695 | 4/1994 | Shopsowitz . | |
| 5,421,783 | 6/1995 | Kockelman et al. . | |

OTHER PUBLICATIONS

Picture of "Large Trebuchet".
Company Profile of Bungee Adventures, Inc.

*Primary Examiner*—Kien T. Nguyen

*Attorney, Agent, or Firm*—Randy W. Lacasse

[57] ABSTRACT

An amusement ride for catapulting a human rider, enclosed within a capsule, into the air in much the same fashion as ancient armies would hurl large boulders over the walls of castles. The ride provides many of the sensations and thrills encountered by fighter pilots launching from the decks of aircraft carriers without the requirement for flight training or the associated dangers. The ride essentially consists of a siege type catapult and a releasably connected launch pod. When in the launch position, a release mechanism is triggered by the operator and the rider is catapulted into the air at a physiologically safe rate of acceleration along a predictable free-flight arc. When an acceptable elevation is reached, the rider is separated from the capsule and gently brought back to earth using an automatically deploying parachute or similar device. An alternate embodiment envisions the use of a similar device to project a conveyance vehicle along a horizontal track similar to a stone skipping across the water.

18 Claims, 3 Drawing Sheets

HUMAN FREE-FLIGHT CATAPULT

BACKGROUND OF THE INVENTION

1. Field of Invention

This invention relates generally to a catapult amusement ride, and more specifically to a catapult which provides controllable acceleration and a predictable trajectory for passenger conveyance.

2. Discussion of Prior Art

Traditionally, catapults have been used as weapons launch platforms. In ancient times, warriors used catapults as siege engines to hurl heavy rocks and pieces of metal across moats and over walls into castles or cities. A single archer could launch a large number of arrows at a target at one time using an arrow catapult. These early catapults ranged in complexity from bent trees and rope to complex mechanical designs.

In modern naval warfare, a catapult is used to launch planes from the decks of aircraft carriers. This type of catapult requires a huge steel framework equipped with tracks. A car carrying the plane runs on the tracks. By means of steam, a strong spring, or an explosive charge, the car and plane are shot forward and the plane is launched into the air.

In military aircraft safety systems, a type of catapult is used to provide controllable acceleration to an aircraft ejection seat. In operation, this device provides for a high velocity and high acceleration along a pre-determined path. A predictable flight path and rapid acceleration will allow a pilot's parachute to open at a safe distance from the damaged aircraft in the flight condition.

A primary consideration for rapid acceleration conveyances is limiting the rate of acceleration to physiologically acceptable values so as to reduce the potential for injuries. Other considerations include providing for deceleration and for controlled contact with the ground or water.

SUMMARY OF THE INVENTION

It is an object of the present invention to provide an amusement ride which utilizes a pod or similar conveyance to safely propel a rider along a predictable path. It is another object of the present invention to provide for the separation of the rider and launch pod in flight. It is further an object of the invention to provide for the safe landing of the rider.

These and other objects of the present invention will become apparent when taken in conjunction with the drawings, claims and description of the preferred embodiments of the invention.

The present invention utilizes a bungee/shock cord-activated lever to propel a launch pod into the air along a predictable trajectory. Just prior to reaching the apogee of a pre-defined trajectory, the rider is controllably separated from the launch pod. Deceleration and landing are facilitated through the use of a parachute or similar device, which automatically opens upon achieving a safe separation distance from the launch pod. To improve safety and equipment wear, an open body of water is used as the landing zone.

DESCRIPTION OF THE PREFERRED EMBODIMENTS

Figure 1:
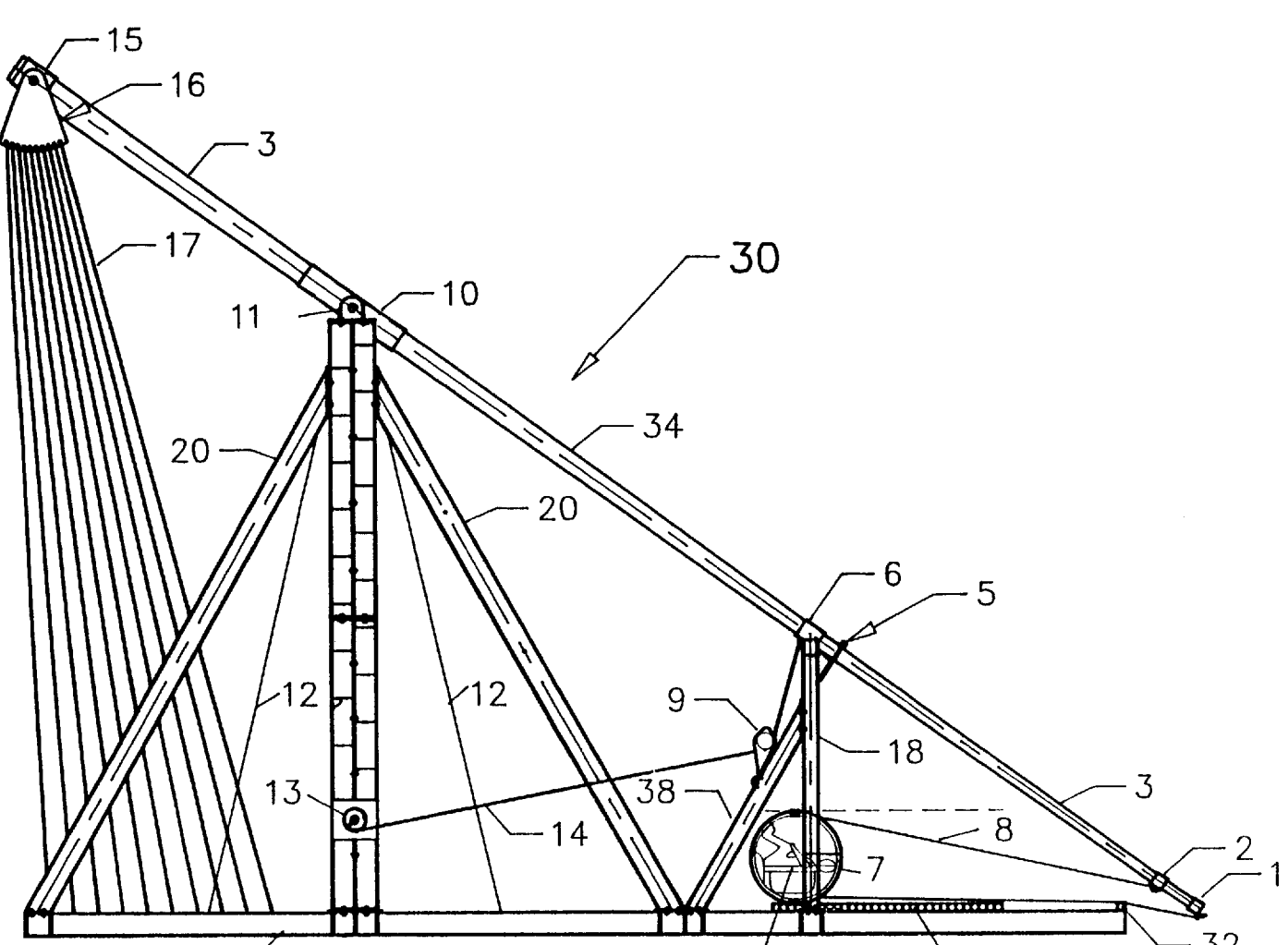
FIG. 1 is a side view of the bungee catapult and module.
Figure 2:
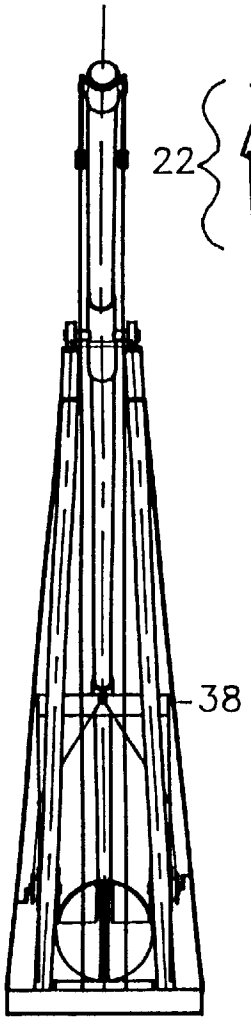
FIG. 2 is a forward view of the bungee catapult in the pre-launch position.

Referring to FIGS. 1 and 2, bungee catapult 30 includes a base assembly 19, which provides a secure platform for mounting the primary structures, verge/launch lever 3, roller assembly 4, launch pod 7 with internal closed cell foam padding, sling assembly 8, launch lever support cradle 18, base assembly 19, pivot post assembly 21 and padded pivot post support braces 20. Verge/launch lever 3 more specifically includes hooked end fitting 1 and sling holding fitting 2, which provide the attachment points for connecting sling 8, recocking fitting 6, and launch lever pivot fitting 10. Launch lever pivot fitting 10 provides an attachment point connecting verge/launch lever 3 to pivot bearing 11 (axis of rotation for launch lever 3). End counter-weight fitting 15 connects counterweight/bungee attachment plate 16 to the verge/launch lever 3. Launch lever support cradle 18, upon which the launch lever 3 rests when in the prelaunch position, more specifically includes trigger assembly 5, which locks the launch lever in the pre-launch position; and support brace 38, upon which turning block 9 is attached. Pivot post assembly 21 more specifically includes padded pivot post support braces 20, guide wires 12, and recocking winch 13. Padded cross struts (not shown) may be added between the support braces 20 for greater stability of the device. Energy translation assembly 22 more specifically includes counterweight/bungee attachment plate 16 and bungee/shock cords 17 which provide the source of acceleration. Recocking line 14 is attached at one end to recocking winch 13 and at the other end to recocking fitting 6 via turning block 9. The pre-launch and the post-launch conditions of the present invention will be further explained below.

Figure 5:
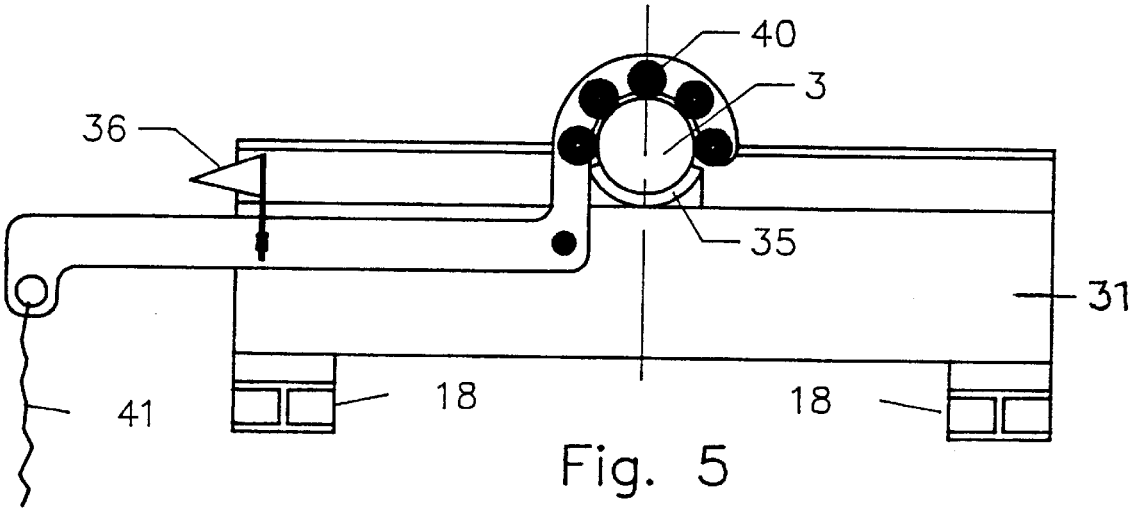
FIG. 5 illustrates the trigger mechanism of the present invention.

Recocking line 14 may be one or more flexible ropes or cables of suitable construction (i.e., non-stretch polyester rope, etc.). This line(s) can overcome, within a suitable safety margin, the elastic force generated when bungee/shock cords 17 are stretched to the pre-launch position. Recocking winch 13 is a motor/manually operated winch (e.g., two-speed, self-tailing) that provides the necessary energy, leveraged against stretched bungee/shock cords 17, to retain the lever 3 in the pre-launch position, where trigger assembly 5 locks the launch lever in position until trigger 31 (as shown in FIG. 5) is released. Recocking line 14 has a length sufficient to allow attachment to recocking fitting 6 via turning block 9, when the launch lever is in the postlaunch/extended position.

The pre-launch position is defined as that position where the launch lever 3 is resting on launch lever support cradle 18, with trigger assembly 5 engaged. Recocking winch 13, after 10 being used to draw the launch lever into pre-launch position, is disengaged by removing recocking line 14 which is then coiled for release between elements 6 and 9. Additionally, in the pre-launch position, bungee/shock cords 17 are fully extended thereby placing a strain on launch lever 3 via counterweight and bungee attachment plate 16, at a position opposite to that of the attachment point for launch pod 7. In the pre-launch position, launch pod 7 is positioned below the launch lever support cradle assembly 18 on a roller assembly 4 with the rider 24 enclosed face up.

Launch pod 7 is releasably connected to launch lever 3 by sling assembly 8 which has a first section comprising a sling composed of a material of suitable strength such as Kevlar® or a similar strong non-stretch material. Sling assembly 8 is attached to the launch lever 3 by a second section comprising doubled bungee cords at hooked end fitting 1 and sling holding fitting 2. The use of bungee/shock cords in this fashion induces a lag (reduced physiological acceleration) between the launch pod 7 and the verge/launch lever 3 thus creating a snap effect. Sling roller bearing 32 reduces friction and prevents chafing of the sling against the base during launch. The post-launch position is defined as that position, achieved upon the launch of launch pod 7, where bungee/shock cords 17 are in the non-tensioned position and the weight of launch lever 3 is fully supported by pivot post assembly 21. Auxiliary facilities (not shown) are provided to pre-position the next launch module within the staging area.

Base assembly 19 may be the flatbed of a large truck-drawn trailer or a suitable foundation mounted on a level surface. This structure provides connection points for the roller assembly 4, sling roller bearing 32, launch lever support cradle assembly 18, pivot post assembly 21, guide wires 12 and bungee/shock cords 17. Additionally, guide wires 12 may be steel cables which provide additional support to pivot post assembly 21.

Bungee/shock cords 17 are formed of a relatively elastic material and are approximately one inch in diameter. The number, size, elasticity and configuration of the bungee/shock cords utilized in energy translation assembly 22 are sufficient to provide a suitable force for accelerating launch pod 7 at a physiologically safe rate. The cords may be arranged in a single fanned orientation fashion or doubled-up in the same configuration. These cords may be easily replaced when required, because of damage or normal wear, using known methods.

Referring to FIG. 5, trigger 31 is pushed up when set against verge 3 by an operator standing on a platform. The trigger goes over the verge center and pushes against pad 35. Locking pin 36 is then inserted so lanyard 41 cannot be inadvertently pulled (as on military aircraft). After safety conditions are ensured, the operator removes the pin, pulls down hard on the lanyard and the verge is released. Rollers 40 cut friction in cocking and releasing.

Figure 3:
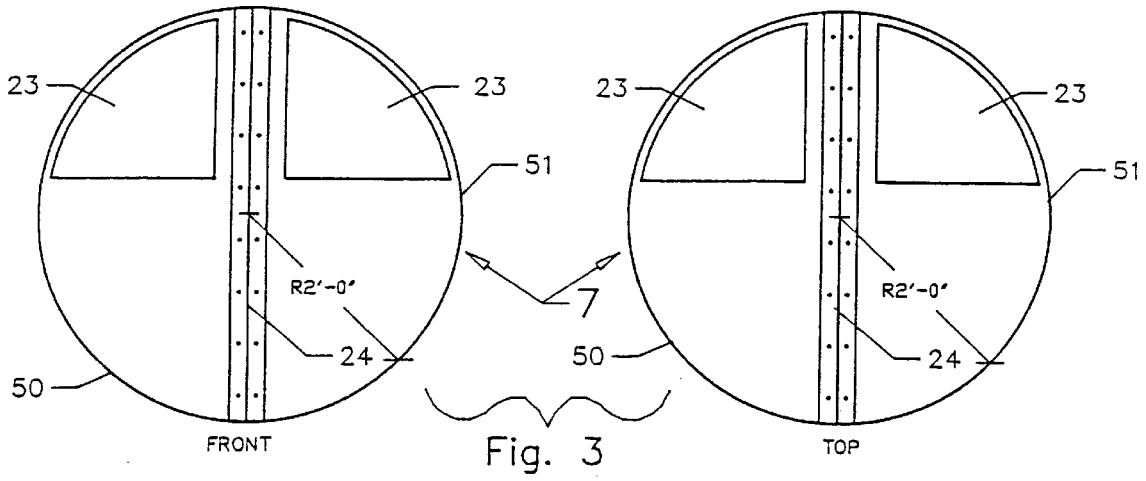
FIG. 3 is a frontal view of the capsule/launch pod with view ports 23 and aluminum strip 24 in the closed position.
Figure 4:
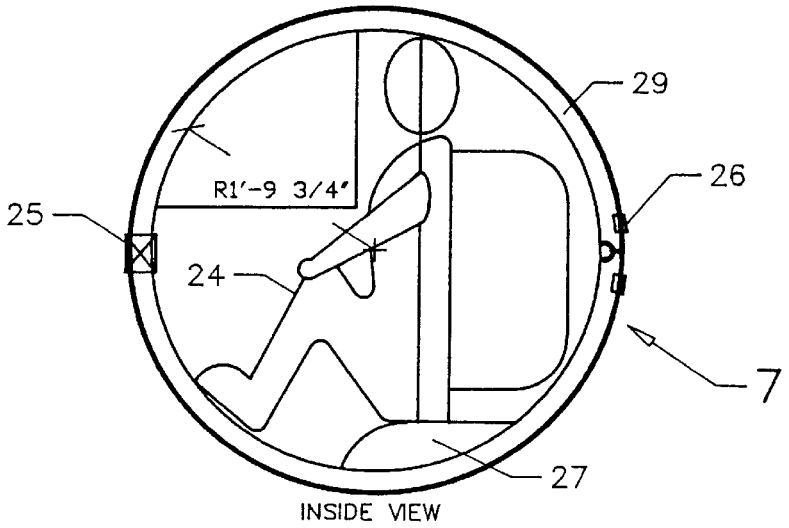
FIG. 4 is an interior side view of the capsule/launch pod 7 with rider 24 in the pre-separation position.

In the preferred embodiment, launch pod 7 (FIGS. 3 and 4) is utilized as the primary conveyance for rider(s) 24. Conveyance units are pre-loaded with riders and pre-positioned for attachment to the amusement ride. Rider(s) 24 is assisted with donning parachute/decelerator 28 and undergoes a safety inspection. Launch pod 7 is opened and one or more rider(s) 24 is positioned on seat 27. Launch pod 7 is closed and locked using locking mechanism 25, which remains locked until automatically unlocked upon safely clearing the catapult and reaching the appropriate altitude, or unlocked by the rider 24 or an operator on the ground (remote controlled). In the preferred embodiment, the bifurcated launch pod 7, upon being unlocked, opens at hinges 26 as the right and left sides 50 and 51 respectively rotate on the axis of the hinges. Once slightly opened, the wind resistance will complete the opening process and quickly slow the pod as compared to the projected rider(s). A tail, approximately 30 feet long and 3 inches in width, may be used to stabilize the launch pod.

In operation, launch pod 7 is positioned on roller assembly 4 with rider(s) 24 face-up in the pre-launch position. Recocking winch 13 is engaged and launch lever 3 is lowered onto the launch lever support cradle assembly 18 and locked in position by trigger assembly 5. Launch pod 7 is attached to launch lever 3 using sling assembly 8 at hooked end fitting 1 and sling holding fitting 2. Recocking winch 13 is disengaged and the recocking line is removed from the winch and coiled placing the amusement ride in the final pre-launch position. Upon ensuring that conditions for safety are met, trigger 31 is activated and launch pod 7 accelerates at a physiologically safe rate along roller assembly 4 and is elevated as launch lever 3 pivots about launch lever pivot bearing 11, hurling it into the air along a predictable arc (i.e., elevation and path of travel) upward and in a direction from right-to-left (FIG. 1). Upon clearing the catapult assembly and reaching an acceptable altitude, locking mechanism 25 is released and the rider(s) 24 is separated from launch pod 7. Once clear, parachute/decelerator 28 opens safely, decelerating rider 24 for a soft landing. Launch pod 7 has its own parachute(s) (not shown) which allow(s) for a soft landing and minimal wear. To further increase safety and decrease equipment wear, the landing area is preferably a large water-filled area such as a lake or bay. Upon landing, launch pod 7 is recovered, inspected for damage and prepared for the next cycle.

In an alternate embodiment, the present invention 30 is placed onto its side (rotated 90 degrees) and launch pod 7 is accelerated along a plane parallel to the ground with little or no elevation. Launch pod 7 will be propelled across a body of water, skipping like a rock thrown nearly parallel to the surface of a pond. The structural design of the invention will be essentially the same as previously discussed, but rotated on its side. Base 19 may be hinged along one or both sides to allow the top of the base to be rotated the 90 degrees. In addition, a second set of rollers(not shown) will be added orthogonally to the first set to facilitate movement along the plane of the ground. Guide wires 12 should be upgraded to I-beams to provide lateral support.

While the invention has been described in its presently preferred embodiments it is understood that the words which have been used are words of description rather than words of limitation and that changes may be made without departure from the scope and spirit of the invention in its broader aspects.

CONCLUSION

A system and method has been shown in the above embodiments for the effective implementation of a human free-flight catapult. While various preferred embodiments have been shown and described, it will be understood that there is no intent to limit the invention by such disclosure, but rather, the intent is to cover all modifications and alternate constructions falling within the spirit and scope of the invention as defined in the appended claims. For instance, the device should not be limited by size, specific materials, weight, or specific structural strengths. The lever can be made of conventional carbon fiber as found in a sailboat mast or other equivalent strong flexible materials. The fittings can be made of anodized aluminum, stainless steel or equivalent materials. The pivots and supports can be made of painted steel or other strong, lightweight and weather resistant materials. The bungees may be one inch MIL-spec grade (less if more are used). In addition, various types of pods are envisioned as well as mechanisms for safely removing and landing rider(s) from the pod.

I claim:

1. A catapult amusement ride comprising:

a base divided into a drive support area at a first end, a conveyance support area at a second opposite end, and a pivot post support area located between said first and second ends;

a pivot post having a first end attached to said base;

a lever beam rotatably attached to said pivot post at a distal second end;

an attachment point between said pivot post and said lever beam which divides said lever beam into a drive segment and a conveyance segment;

a plurality of bungee/shock cords attached between the drive segment of said lever and the drive support area of said base;

a conveyance vehicle attached to the end of said conveyance segment and resting on the said conveyance support area of said base during a pre-launch configuration;

a triggered locking assembly attached to said base between said pivot post support area and said conveyance support area of said base;

wherein when said lever device is held by said trigger locking assembly and, upon release of said lever by said trigger locking assembly, said bungee/shock cords pull on said drive segment of said lever causing said conveyance vehicle to be projected into the air by said conveyance segment along a predictable trajectory.

2. A catapult amusement ride as set forth in claim 1, wherein said base is the flatbed trailer of a truck.

3. A catapult amusement ride as set forth in claim 1, wherein said conveyance vehicle will accommodate one or more passengers.

4. A catapult amusement ride as set forth in claim 1, wherein said conveyance vehicle will accommodate two passengers.

5. A catapult amusement ride comprising:

a base having a pivot post;

a lever device:

connection means for attaching said lever device pivotally to said pivot post;

drive means providing rotational acceleration to said lever device;

positioning means for positioning said lever device in a pre-launch position;

a locking means for locking said lever device in a stationary position;

a means for releasing said locking means to provide for the acceleration of said lever device;

a conveyance vehicle for the transportation of passengers;

a means for connecting said conveyance vehicle to said lever device;

a track means for reducing frictional forces on the said conveyance vehicle while in contact with said base;

wherein, upon release of said locking mechanism for said lever device, said lever device is angularly accelerated by said drive means and said conveyance vehicle, connected to said lever device by said connection means, is accelerated along a predictable path.

6. A catapult amusement ride as set forth in claim 5, wherein said base is the flatbed trailer of a truck.

7. A catapult amusement ride as set forth in claim 5, wherein drive means for said lever device are bungee/shock cords.

8. A catapult amusement ride as set forth in claim 5, wherein said positioning means is a motorized winch.

9. A catapult amusement ride as set forth in claim 5, wherein said positioning means is a hand-cranked winch.

10. A catapult amusement ride as set forth in claim 5, wherein said conveyance vehicle will accommodate one or more passenger(s).

11. A catapult amusement ride as set forth in claim 5, wherein said conveyance vehicle will accommodate two passengers.

12. A catapult amusement ride comprising:

a hinged base having a pivot post;

a lever device;

connection means for attaching said lever device pivotally to said pivot post;

drive means providing a rotational acceleration to said lever device; positioning means for positioning said lever device in a pre-launch position which is opposed to the drive means providing said rotational acceleration;

a locking means for locking said lever device in a stationary position; a means for releasing said locking means to provide for the acceleration of said lever device;

a conveyance vehicle for the transportation of passengers;

a means for connecting said conveyance vehicle to said lever device;

a multiplicity of orthogonally oriented track means for reducing frictional forces on the said conveyance vehicle while in contact with said base and a horizontal plane;

wherein, upon release of said locking mechanism for said lever device, said lever device is angularly accelerated along said plane parallel to the ground by said drive means and said conveyance vehicle, connected to said lever device by said connection means, is accelerated along a predictable path.

13. A catapult amusement ride as set forth in claim 12, wherein said hinged base comprises a truck bed support rotated upon said hinges 90 degrees.

14. A catapult amusement ride as set forth in claim 12, wherein drive means for said lever device are bungee/shock cords.

15. A catapult amusement ride as set forth in claim 12, wherein said positioning means is a motorized winch.

16. A catapult amusement ride as set forth in claim 12, wherein said positioning means is a hand-cranked winch.

17. A catapult amusement ride as set forth in claim 12, wherein said conveyance vehicle will accommodate one or more passengers.

18. A catapult amusement ride as set forth in claim 12, wherein said conveyance vehicle will accommodate two passengers.

* * * * *